US006794806B2

(12) United States Patent
Reed

(10) Patent No.: US 6,794,806 B2
(45) Date of Patent: Sep. 21, 2004

(54) WARP-FREE DUAL COMPLIANT TENSION MASK FRAME

(75) Inventor: Joseph Arthur Reed, York, PA (US)

(73) Assignee: Thomson Licensing S. A., Boulogne-Billancourt (FR)

( * ) Notice: Subject to any disclaimer, the term of this patent is extended or adjusted under 35 U.S.C. 154(b) by 0 days.

(21) Appl. No.: 10/180,761

(22) Filed: Jun. 26, 2002

(65) Prior Publication Data

US 2004/0000857 A1 Jan. 1, 2004

(51) Int. Cl.[7] ..... H01J 29/80

(52) U.S. Cl. ..... 313/407; 313/402; 313/404; 313/405

(58) Field of Search ..... 313/402, 404, 313/405, 407, 408, 403; 445/37, 67, 68

(56) References Cited

U.S. PATENT DOCUMENTS

| | | | | |
|---|---|---|---|---|
| 5,952,774 A | * | 9/1999 | Diven et al. | 313/402 |
| 6,573,645 B1 | * | 6/2003 | Bucher | 313/405 |
| 6,597,093 B2 | * | 7/2003 | Yang | 313/402 |
| 6,600,258 B2 | * | 7/2003 | Gorog et al. | 313/402 |
| 6,734,611 B2 | * | 5/2004 | Bucher | 313/407 |
| 2003/0038579 A1 | * | 2/2003 | Bucher | 313/402 |

FOREIGN PATENT DOCUMENTS

| | | | |
|---|---|---|---|
| DE | 10113156 A1 | 10/2001 | H01J/29/82 |
| JP | 2000285820 | 10/2000 | H01J/29/07 |
| WO | WO 00/60636 | 10/2000 | H01J/29/07 |
| WO | WO 03/005403 A2 | 1/2003 | H01J/29/07 |
| WO | WO 03/017316 A1 | 2/2003 | H01J/29/07 |

* cited by examiner

*Primary Examiner*—James Vannucci
*Assistant Examiner*—Jimmy T. Vu
(74) *Attorney, Agent, or Firm*—Joseph S. Tripoli; Joseph J. Laks; Carlos M. Herrera

(57) ABSTRACT

A tension mask frame assembly for use in a cathode ray tube is provided. The tension mask frame assembly includes a substantially rectangular mask support frame, having a first coefficient of thermal expansion. The frame is formed of a pair of opposing long sides being joined to a pair of opposing short sides wherein one of these pairs has an attachment zone. The tension mask, having a second coefficient of thermal expansion, is supported by the frame at the attachment zones along the opposing sides. The attachment zones are formed of a material having a coefficient of thermal expansion which is approximately the same as the second coefficient of thermal expansion in order to be matched with the tension mask.

9 Claims, 2 Drawing Sheets

WARP-FREE DUAL COMPLIANT TENSION MASK FRAME

FIELD OF THE INVENTION

This invention generally relates to cathode ray tubes (CRTs) and, more particularly, to a tension mask frame assembly for CRTs having improved thermal expansion and warp characteristics.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

One type of CRT has a tension mask comprising a set of strands that are tensioned onto a mask support frame to reduce their propensity to vibrate at large amplitudes under external excitation. A tension mask support frame assembly has been developed which includes a pair of support blade members which are welded or otherwise attached to a mask support frame. The tension mask is supported between these support blade members. In order to maintain a desired tension on the tension mask at elevated tube processing temperatures, it is desirable to have matched coefficients of thermal expansion (CTE) in the material which forms the support blade members and the material which forms the tension mask. Thermal expansion mismatch between these components has been found to cause undesirable anomalies in the tension mask surface occurring during the thermal cycling of tube processing. Although the support blade members and tension mask may be formed of matched relatively low CTE materials, such as INVAR, these materials tend to be relatively expensive. It is therefore desirable to form the mask support frame of a relatively inexpensive high CTE material such as steel. A problem occurs however in that where the support blade member having a low CTE is connected to the mask support frame having a high CTE, there is a thermal expansion mismatch. This thermal expansion mismatch causes deflection or warping of the support blade member in the Z-axis direction at elevated tube operating temperatures.

It is desirable to develop a mask frame assembly that allows the use of relatively lower CTE inexpensive material for the mask support frame assembly while preventing excessive Z axis deflection of the mask support blade members during the thermal cycling that occurs during normal CRT operation.

SUMMARY OF THE INVENTION

A tension mask frame assembly for use in a cathode ray tube is provided. The tension mask frame assembly includes a substantially rectangular mask support frame, having a first coefficient of thermal expansion. The frame is formed of a pair of opposing long sides being joined to a pair of opposing short sides wherein one of these pairs has an attachment zone. The tension mask, having a second coefficient of thermal expansion, is supported by the frame at the attachment zones along the opposing sides. The attachment zones are formed of a material having a coefficient of thermal expansion which is approximately the same as the second coefficient of thermal expansion in order to be matched with the tension mask expansion.

BRIEF DESCRIPTION OF THE DRAWINGS

The invention will now be described by way of example with reference to the accompanying figures of which.

DETAILED DESCRIPTION OF THE INVENTION

Figure 1:
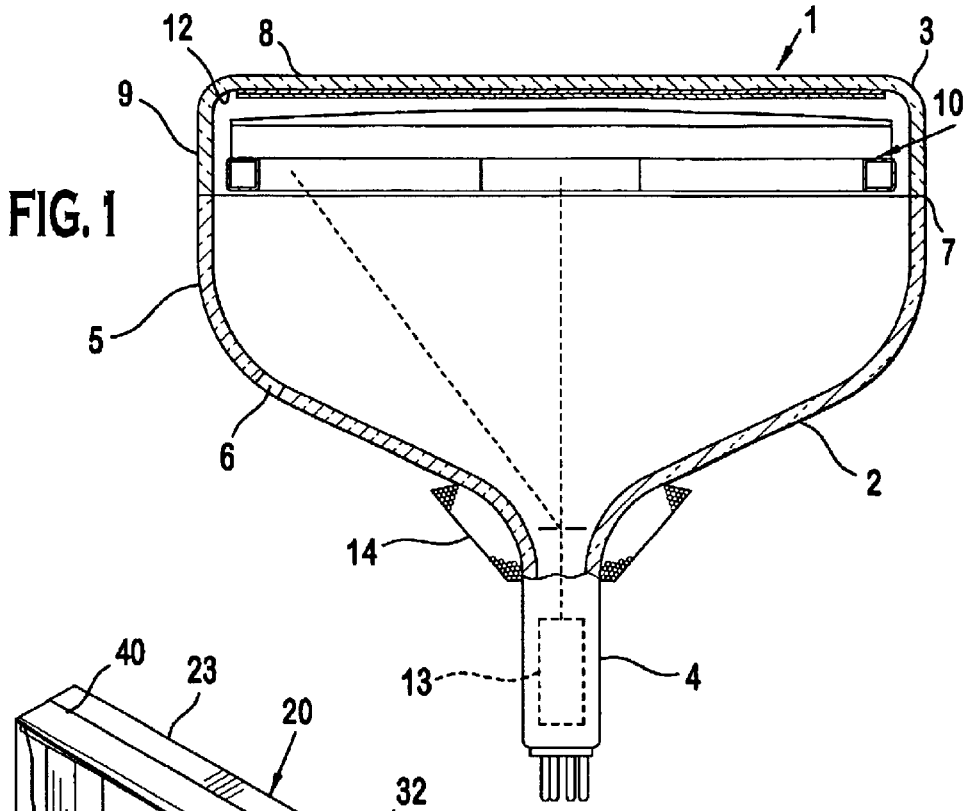
FIG. 1 is a cross sectional view of a CRT showing a tension mask frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A tension mask frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
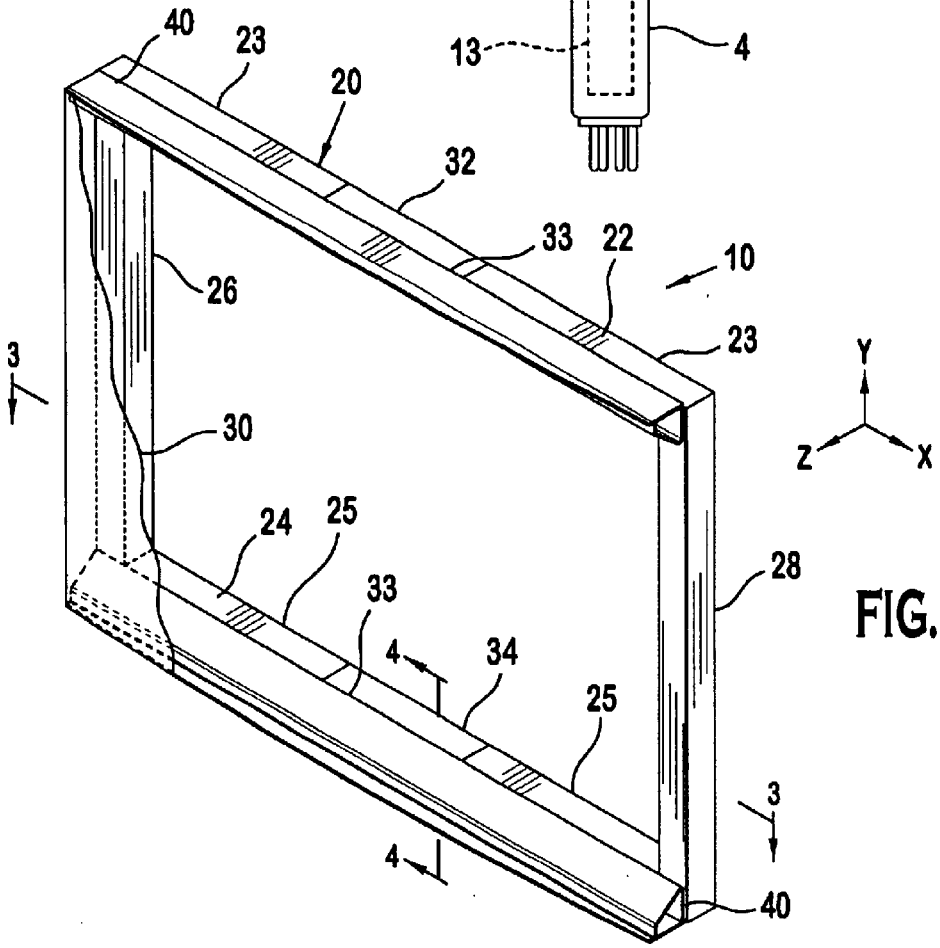
FIG. 2 is a perspective view of the tension mask frame assembly.
Figure 3:
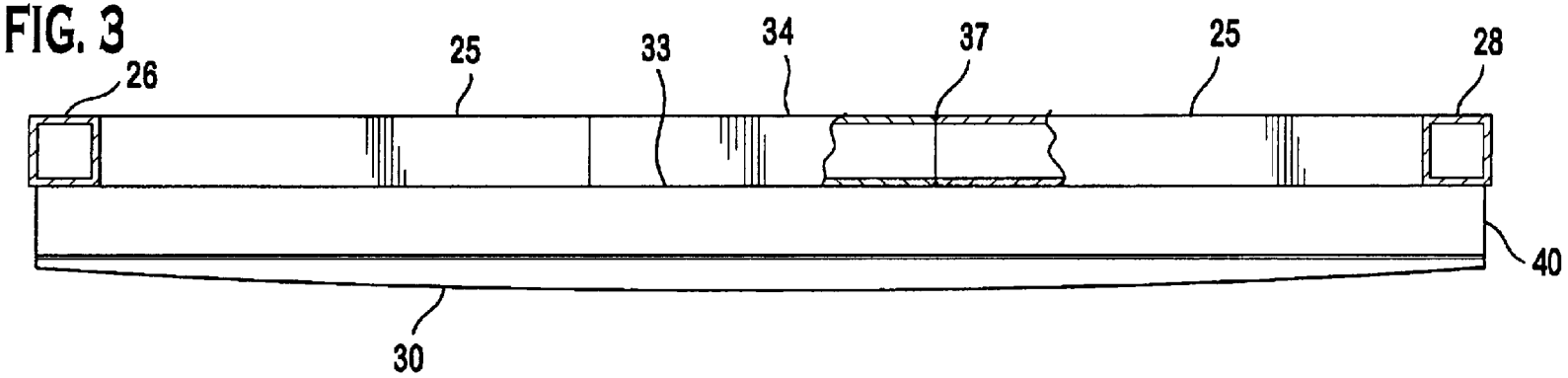
FIG. 3 is a cross sectional view taken along the line 3—3 of FIG. 2.

The tension mask frame assembly 10, as shown in FIGS. 2 and 3, includes two long sides 22 and 24, and two short sides 26 and 28. The two long sides 22, 24 of the tension mask frame assembly 10 are parallel to a central major axis, X, of the tube; and the two short sides 26, 28 parallel a central minor axis, Y, of the tube. The two long sides 22, 24 and two short sides 26, 28 form a continuous planar mask support frame 20 along those major and minor axes.

The frame assembly 10 includes an apertured tension shadow mask 30 (shown here diagrammatically as a sheet for simplicity) that contains a plurality of metal strips (not shown) having a multiplicity of elongated slits (not shown) there-between that parallel the minor axis, Y, of the tube. The mask 30 is fixed to a pair of support blade members 40 which are fastened to the frame 20 at mounting locations 33 (as shown best in FIGS. 2 and 4). The support blade members 40 may vary in height from the center of each support blade member 40 longitudinally to the ends of the support blade member 40 to permit the best curvature and tension compliance over the tension shadow mask 30.

Figure 4:
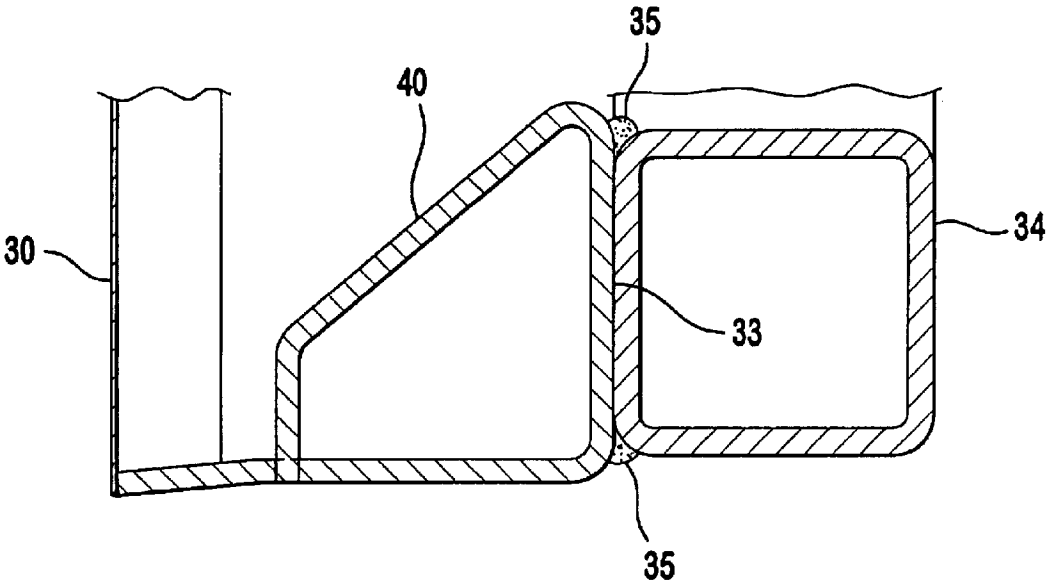
FIG. 4 is a cross sectional view taken along the line 4—4 of FIG. 2.

The two long sides 22, 24 of the tension mask frame assembly 10 each contain a matched section 32, 34 which is a structural member welded between end sections 23, 25. The material utilized in forming the matched sections 32, 34 is matched to the CTE of the support blade member 40 and is preferably a relatively low CTE material. The end sections 23, 25 are attached to the matched sections 32, 34 by a weld or other suitable attachment means. FIG. 3 shows a cross sectional view wherein a portion of the long side 24 is cut away to show a weld 37 between the end sections 25 and the matched portion 34. Each of the matched sections 32, 34 are located approximately in the center of the long sides 22, 24 at an attachment zone where the support blade member 40 is attached thereto either by mechanical fasteners or by welding. Referring to FIG. 4, an example of this attachment is shown wherein the support blade member 40 is welded to a portion of the matched section 34 by welds 35.

In assembly, the tension mask frame assembly 10 is formed by first attaching the short sides 26, 28 to the end portions 23, 25 of the long sides 22, 24. The matched sections 32, 34 are then welded to the end portions 23, 25 respectively by welds 37 (FIG. 3) to complete the frame 20. A pair of support blade members 40 are then welded to the matched sections 32, 34 by welds 35 as best shown in FIG. 4. Finally, the tension mask 30 is applied to the support blade members 40 to complete the tension mask frame assembly 10.

It should be understood that the material of the CTE matched sections 32, 34 have a same or similar coefficient of thermal expansion as the material from which the support blade members 40 are formed. This matching of coefficients of thermal expansion is advantageous to prevent deflection or warping of the support blade members 40 in the Z-axis direction during heating which occurs during normal CRT operation.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A tension mask frame assembly for a CRT comprising:

a substantially rectangular mask support frame having a first coefficient of thermal expansion and including a pair of opposing long sides joined to a pair of opposing short sides, one of the pair of opposing long and short sides having attachment zones;

a tension mask having a second coefficient of thermal expansion being supported by the frame at the attachment zones along the opposing sides; and the attachment zones being formed of a material having a coefficient of thermal expansion which is approximately the same as the second coefficient of thermal expansion.

2. A tension mask frame assembly according to claim 1 wherein the attachment zones each comprise a structural member disposed between end sections of the respective side.

3. A tension mask frame assembly of claim 2 wherein the structural member is welded to the end sections.

4. The tension mask frame assembly of claim 2 further comprising a pair of support blade members each being attached to a respective attachment zone for supporting the tension mask.

5. The tension mask frame assembly of claim 4 wherein each of the support blade members is formed of a material having the second coefficient of thermal expansion.

6. A cathode ray tube having an electron gun for directing electron beams toward a screen and a mask disposed between the electron gun and the screen; the cathode ray tube comprising:

a frame assembly for supporting the mask having a pair of opposing long sides and a pair of opposing short sides forming a rectangular mask support frame, one of the pair of opposing long and short sides being formed of end sections flanking a matched section wherein the end sections have a first coefficient of thermal expansion and the matched section has a second coefficient of thermal expansion which is substantially similar to a coefficient of thermal expansion of the mask.

7. The cathode ray tube of claim 6 wherein the matched section is attached to the end sections by a weld.

8. The cathode ray tube of claim 7 further comprising a pair of support blade members being attached to the matched sections for supporting the mask.

9. The cathode ray tube of claim 8 wherein the support blade members are formed of a material having a coefficient of thermal expansion which is substantially similar to the second coefficient of thermal expansion.

* * * * *